US012778203B2

(12) United States Patent
Zhou

(10) Patent No.: US 12,778,203 B2
(45) **Date of Patent: *Nov. 3, 2026**

(54) VAPORIZER AND ELECTRONIC VAPORIZATION DEVICE

(71) Applicant: SHENZHEN SMOORE TECHNOLOGY LIMITED, Shenzhen (CN)

(72) Inventor: Jianguang Zhou, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 402 days.

This patent is subject to a terminal disclaimer.

(21) Appl. No.: 17/730,728

(22) Filed: Apr. 27, 2022

(65) Prior Publication Data

US 2022/0354180 A1 Nov. 10, 2022

(30) Foreign Application Priority Data

May 10, 2021 (CN) ..... 202120988037.5

(51) Int. Cl.
*A24F 40/485* (2020.01)

(52) U.S. Cl.
CPC ..... *A24F 40/485* (2020.01)

(58) Field of Classification Search
None
See application file for complete search history.

(56) References Cited

U.S. PATENT DOCUMENTS

| | | | |
|---|---|---|---|
| 10,631,576 B1 | 4/2020 | Chen et al. | |
| 2015/0173417 A1 | 6/2015 | Gennrich et al. | |
| 2015/0305403 A1* | 10/2015 | Coelho Belo Fernandes De Carvalho | F22B 1/284 131/328 |

(Continued)

FOREIGN PATENT DOCUMENTS

| | | |
|---|---|---|
| CN | 203040678 U | 7/2013 |
| CN | 204949527 U | 1/2016 |

(Continued)

OTHER PUBLICATIONS

CN-111109660-A Description English Translation obtained from Espacenet, pp. 1-19 (Year: 2024).*

(Continued)

*Primary Examiner* — Philip Y Louie
*Assistant Examiner* — Virginia R Bieger
(74) *Attorney, Agent, or Firm* — Leydig, Voit & Mayer, Ltd.

(57) ABSTRACT

A vaporizer for an electronic vaporization device having an accommodating cavity accommodating a battery includes: a housing having an air outlet; a safety valve; and an inner tube disposed in the housing. The air outlet is on one end of the inner tube. The safety valve is at least partially disposed in a tube cavity of the inner tube, the tube cavity including an airflow channel, the airflow channel being provided between the safety valve and the air outlet. The inner tube includes an air guide hole, the air guide hole providing for airflow to run through the airflow channel and the accommodating cavity, the air guide hole including openings on both an outer wall surface and an inner wall surface of the inner tube.

12 Claims, 6 Drawing Sheets

(56) References Cited

U.S. PATENT DOCUMENTS

| | | | | |
|---|---|---|---|---|
| 2017/0196268 | A1 | 7/2017 | Reevell | |
| 2018/0303158 | A1* | 10/2018 | Chen | B65D 50/04 |
| 2019/0297952 | A1 | 10/2019 | Qiu | |
| 2022/0071283 | A1 | 3/2022 | Qiu | |

FOREIGN PATENT DOCUMENTS

| | | | | | |
|---|---|---|---|---|---|
| CN | 105795522 | A | * | 7/2016 | |
| CN | 106028850 | A | | 10/2016 | |
| CN | 106455690 | A | | 2/2017 | |
| CN | 206294897 | U | | 7/2017 | |
| CN | 206727144 | U | | 12/2017 | |
| CN | 108576938 | A | | 9/2018 | |
| CN | 208523779 | U | | 2/2019 | |
| CN | 208819948 | U | | 5/2019 | |
| CN | 209234987 | U | | 8/2019 | |
| CN | 111109660 | A | * | 5/2020 | A24F 40/10 |
| CN | 212306803 | U | | 1/2021 | |
| WO | 2015120588 | A1 | | 8/2015 | |

OTHER PUBLICATIONS

CN-105795522-A Description English Translation obtained from Espacenet, pp. 1-18 (Year: 2024).*

Chinese Patent Office, Notification of grant of patent right for invention in Chinese Patent Application No. 202010025818.4 (Jan. 8, 2025).

Chinese Patent Office, Office Action in Chinese Patent Application No. 202010025818.4 (Nov. 13, 2024).

European Patent Office, Intention to Grant in European Patent Application No. 20196849.2 (May 17, 2023).

European Patent Office, Search Report in European Patent Application No. 20196849.2 (Feb. 11, 2021).

U.S. Patent and Trademark Office, Notice of Allowance in U.S. Appl. No. 17/022,316 (Nov. 16, 2022).

* cited by examiner

VAPORIZER AND ELECTRONIC VAPORIZATION DEVICE

CROSS-REFERENCE TO PRIOR APPLICATION

Priority is claimed to Chinese Patent Application No. CN 202120988037.5, filed on May 10, 2021, the entire disclosure of which is hereby incorporated by reference herein.

FIELD

The utility model relates to the field of electronic vaporization technologies, and in particular, to a vaporizer and an electronic vaporization device.

BACKGROUND

An electronic vaporization device includes a power supply assembly and a vaporizer, a battery in the power supply assembly supplies power to the vaporizer, and the vaporizer converts electric energy into thermal energy, so that a vaporization substrate stored in the vaporizer is vaporized to form aerosols that can be inhaled by a user. However, for a conventional electronic vaporization device, when the battery explodes in a special situation, shock waves formed by the explosion may carry explosive powders and harmful gas and dash to a mouth of a person quickly through an air outlet, leading to damage to the user, which seriously affects the use security of the electronic vaporization device.

SUMMARY

In an embodiment, the present invention provides a vaporizer for an electronic vaporization device having an accommodating cavity accommodating a battery, the vaporizer comprising: a housing comprising an air outlet; a safety valve; and an inner tube disposed in the housing, wherein the air outlet is on one end of the inner tube, wherein the safety valve is at least partially disposed in a tube cavity of the inner tube, the tube cavity comprising an airflow channel, the airflow channel being provided between the safety valve and the air outlet, wherein the inner tube comprises an air guide hole, the air guide hole being configured for airflow to run through the airflow channel and the accommodating cavity, the air guide hole comprising openings on both an outer wall surface and an inner wall surface of the inner tube, wherein, when a difference between an air pressure in the accommodating cavity and an air pressure in the airflow channel is less than a threshold pressure, the safety valve is located at a first position so as to cause the air guide hole to be in an opened state, and wherein, when the difference between the air pressure in the accommodating cavity and the air pressure in the airflow channel is greater than the threshold pressure, the safety valve is configured to move from the first position to a second position so as to cause the air guide hole to be in a closed state.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
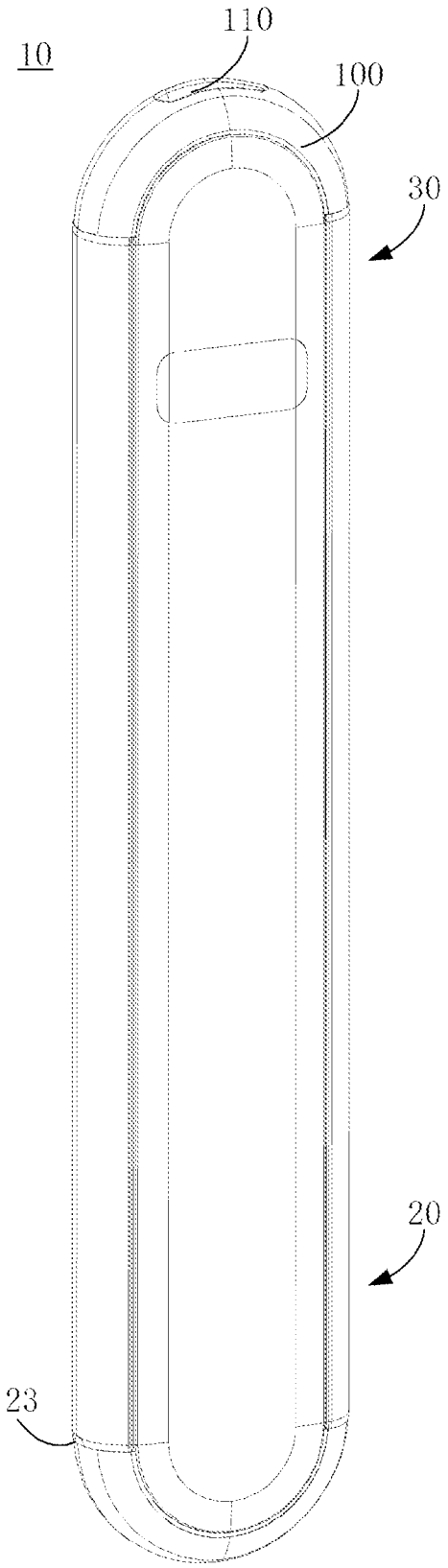
FIG. 1 is a three-dimensional schematic structural diagram of an electronic vaporization device according to an embodiment.

In an embodiment, the present invention improves the use security of an electronic vaporization device. A vaporizer is provided, applicable to an electronic vaporization device, the electronic vaporization device including an accommodating cavity accommodating a battery, and the vaporizer including:

a housing, provided with an air outlet; and a safety valve and an inner tube, disposed in the housing, where the air outlet is on one end of the inner tube, the safety valve is at least partially disposed in a tube cavity of the inner tube, the tube cavity includes an airflow channel, the airflow channel is provided between the safety valve and the air outlet, the inner tube is provided with an air guide hole, the air guide hole is provided for airflow to run through the airflow channel and the accommodating cavity, and the air guide hole is provided with openings on both an outer wall surface and an inner wall surface of the inner tube;

when a difference between an air pressure in the accommodating cavity and an air pressure in the airflow channel is less than a threshold pressure, the safety valve is located at a first position to cause the air guide hole to be in an opened state; and when the difference between the air pressure in the accommodating cavity and the air pressure in the airflow channel is greater than the threshold pressure, the safety valve moves from the first position to a second position to cause the air guide hole to be in a closed state.

In an embodiment, the safety valve is in interference fit with the tube cavity, and the safety valve overcomes frictional resistance and moves from the first position to the second position.

In an embodiment, the safety valve slides from the first position to the second position. In an embodiment, an end portion of the tube cavity includes an opening that is in direct communication with the accommodating cavity, the safety valve includes a sensing surface disposed facing the battery, and the air pressure in the accommodating cavity directly acts on the sensing surface through the opening.

In an embodiment, the inner tube includes an abutting surface forming a set angle with an axial direction of the inner tube and defining a partial boundary of the tube cavity, the safety valve includes a limiting surface disposed facing away from the battery, and when the safety valve is located at the second position, the limiting surface abuts against the abutting surface.

In an embodiment, the vaporizer further includes a vaporization core disposed in the tube cavity, and when the safety valve is located at the first position, the safety valve and the vaporization core are located on two opposite sides of the air guide hole in an axial direction of the inner tube.

In an embodiment, a value range of the threshold pressure is from 1 KPa to 2 Mpa. In an embodiment, a value range of the threshold pressure is from 10 KPa to 1 Mpa. In an embodiment, the vaporizer further includes at least one of the following solutions:

the inner tube being integrally formed and connected; and the inner tube being an inner tube made of a stainless steel material, and the safety valve being a safety valve made of a silica gel material.

An electronic vaporization device is provided, including a power supply assembly and the vaporizer according to any one of the foregoing that are connected to each other, where the power supply assembly is provided with an accommodating cavity and includes a battery accommodated in the accommodating cavity.

A technical effect of an embodiment of the utility model is that: in a case that the battery is normal, the difference between the air pressure in the accommodating cavity and the air pressure in the airflow channel is less than the threshold pressure, the safety valve is located at the first position and the air guide hole is in an opened state, so that external air can enter the airflow channel through the air guide hole to ensure that the electronic vaporization device can work normally. In a case that the battery explodes, the difference between the air pressure in the accommodating cavity and the air pressure in the airflow channel is greater than the threshold pressure, the safety valve moves from the first position to the second position to cause the air guide hole to be in a closed state, shock waves formed by the explosion of the battery in the accommodating cavity cannot carry powders and harmful gas to be inhaled by the user through the air guide hole and the airflow channel, thereby preventing impacting force of the explosion and the powders and harmful gas from causing damage to a human body, and finally improving the use security of the electronic vaporization device.

To help understand the utility model, the following describes the utility model more fully with reference to the related accompanying drawings. The accompanying drawings show exemplary implementations of the utility model. However, the utility model may be implemented in many different forms, and is not limited to the implementations described in this specification. On the contrary, the implementations are provided to make understanding of the disclosed content of the utility model more comprehensive.

It should be noted that, when an element is referred to as "being fixed to" another element, the element may be directly on the another element, or an intervening element may be present. When an element is considered to be "connected to" another element, the element may be directly connected to another element, or an intervening element may be also present. The terms "inner", "outer", "left", "right", and similar expressions used in this specification are only for purposes of illustration but not indicate a unique implementation.

Referring to FIG. 1, an electronic vaporization device 10 provided by an embodiment of the utility model includes a power supply assembly 20 and a vaporizer 30. The vaporizer 30 is detachably connected to the power supply assembly 20, or the vaporizer 30 and a power supply may alternatively form a non-detachable connection.

Figure 2:
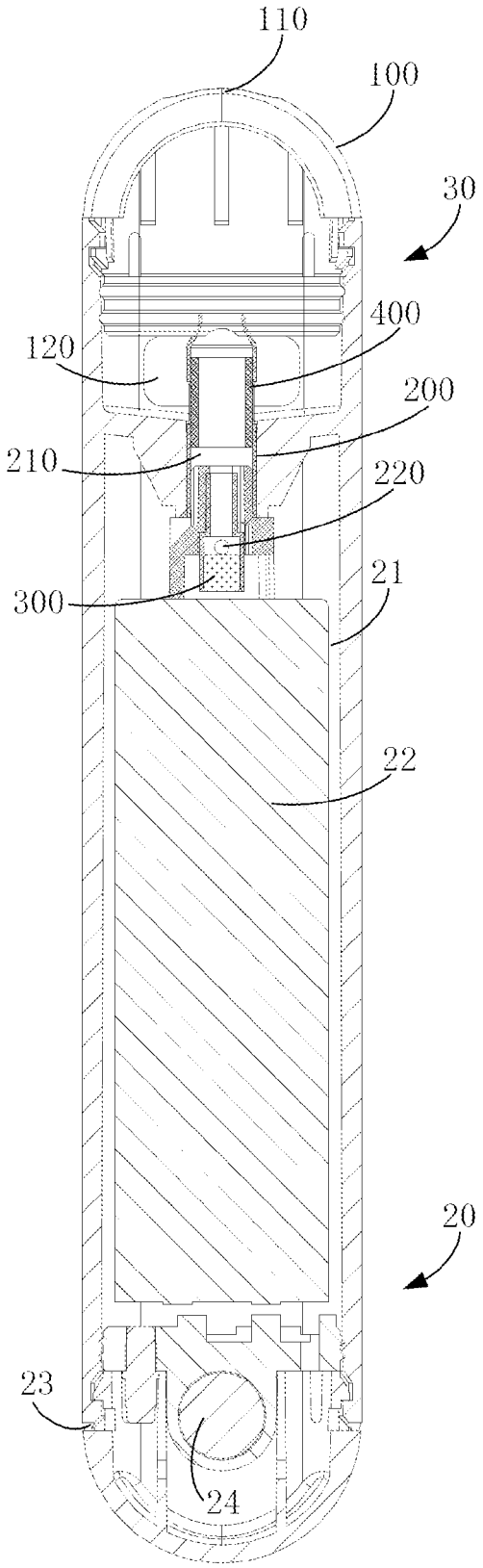
FIG. 2 is a planar schematic cross-sectional structural view of the electronic vaporization device shown in FIG. 1.
Figure 3:
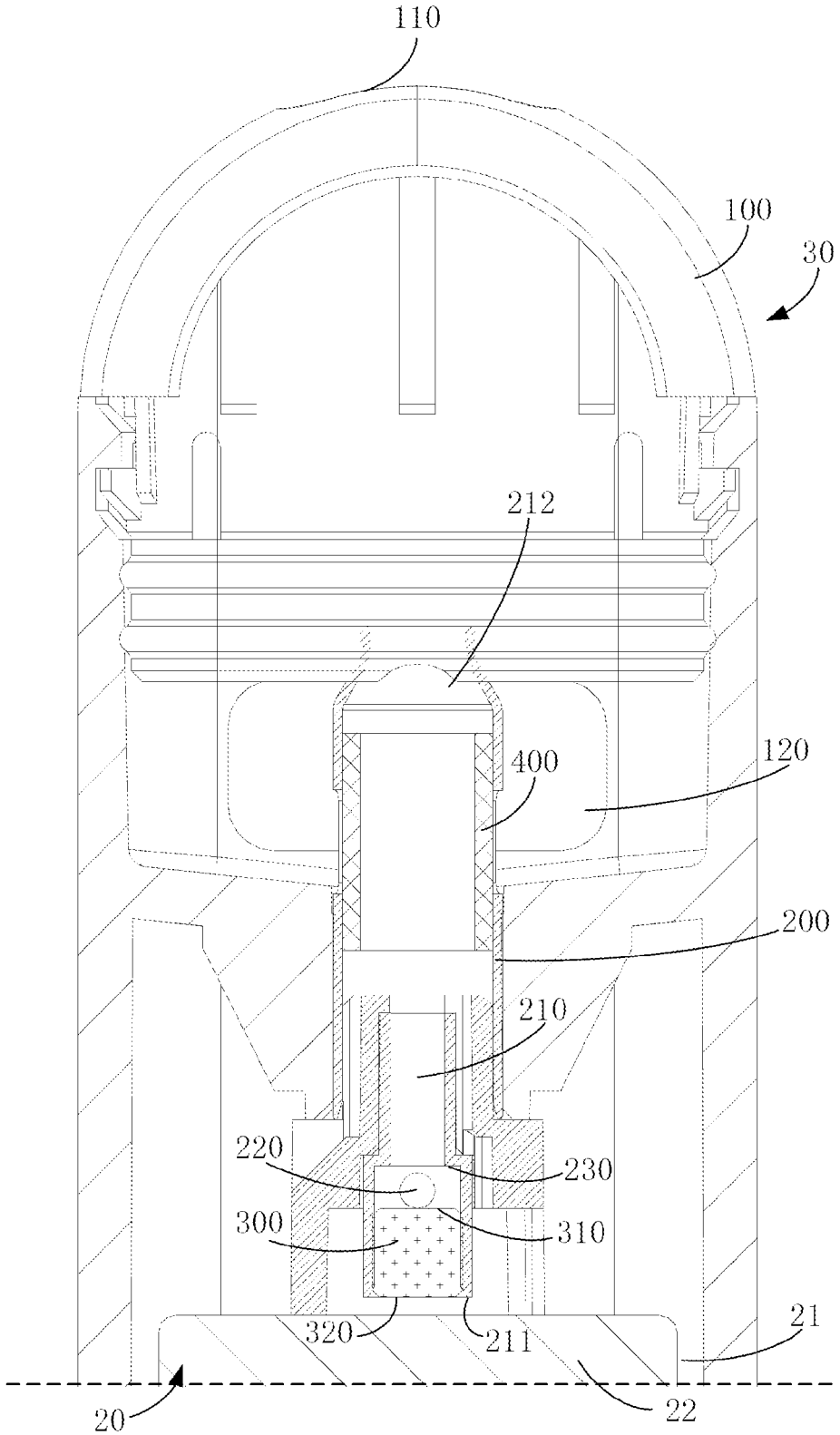
FIG. 3 is a schematic diagram of a partial structure of FIG. 2.

Referring to FIG. 1, FIG. 2, and FIG. 3, in some embodiments, an accommodating cavity 21 is provided in the power supply assembly 20, and the power supply assembly 20 includes a battery 22 and an air pressure sensor 24. The battery 22 and the air pressure sensor 24 are both accommodated in the accommodating cavity 21, and the battery 22 is configured to supply power to the vaporizer 30, so that the vaporizer 30 converts electric energy into thermal energy. An air inlet hole 23 may be further provided on the power supply assembly 20. The air inlet hole 23 communicates the outside with the accommodating cavity 21, and when the electronic vaporization device 10 works due to inhaling of a user, under action of an inhaling force, an air pressure in the accommodating cavity 21 is lower than an air pressure of the outside. On one hand, external air may smoothly enter and fill the accommodating cavity 21 under action of a negative pressure; and on the other hand, the air pressure sensor can quickly perceive presence of the negative pressure in the accommodating cavity 21 and cause the battery 22 to supply power to the vaporizer 30, to ensure normal working of the vaporizer 30.

Figure 4:
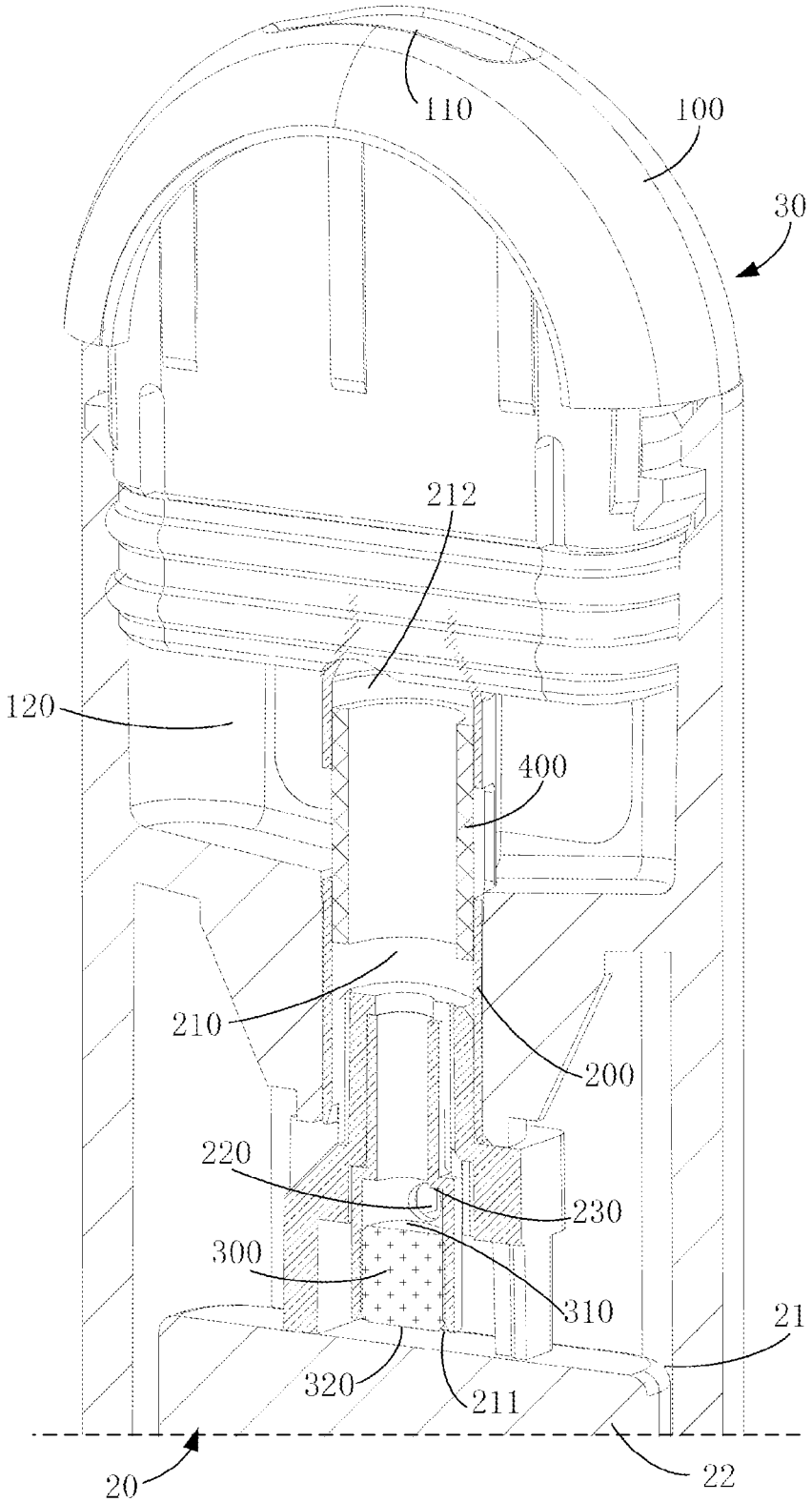
FIG. 4 is a three-dimensional schematic cross-sectional structural view in a first direction of the electronic vaporization device shown in FIG. 1.

Referring to FIG. 2, FIG. 3, and FIG. 4, in some embodiments, the vaporizer 30 includes a housing 100, an inner tube 200, a safety valve 300, and a vaporization core 400. The inner tube 200 is mounted in the housing 100, a liquid storage cavity 120 is formed between the housing 100 and the inner tube 200, the liquid storage cavity 120 is configured to store a vaporization substrate, and the vaporization substrate is essentially a liquid aerosol-forming substrate. An air outlet 110 that is in direct communication with the outside is provided on the housing 100, the air outlet 110 may be understood as being located on one end of the inner tube 200, and the inner tube 200 encircles a tube cavity 210. The inner tube 200 may be approximately a columnar structure, so that the tube cavity 210 may be also a columnar structure. A cross section of the tube cavity 210 may be a circle, and certainly may alternatively be an ellipse, a rectangle, or a regular polygon. The tube cavity 210 of the inner tube 200 and the air outlet 110 of the housing 100 are in communication with each other.

An air guide hole 220 is provided on the inner tube 200, a cross section of the air guide hole 220 may be a circle, an ellipse, a runway, a rectangle, or a regular polygon, and the air guide hole 220 is provided with openings on both an outer wall surface and an inner wall surface of the inner tube 200. Apparently, the inner wall surface is a circular surface and defines a partial boundary of the tube cavity 210, and the outer wall surface is also a circular surface and disposed surrounding the inner wall surface. In other words, the air guide hole 220 runs through the entire inner tube 200 in a thickness direction of the inner tube 200. The air guide hole 220 is in communication with the accommodating cavity 21 and the tube cavity 210 simultaneously. Specifically, the opening of the air guide hole 220 located on the inner wall surface is in communication with the tube cavity 210, and the opening of the air guide hole 220 located on the outer wall surface is in communication with the accommodating cavity 21. There may be one or more air guide holes 220. For example, there are two air guide holes 220, and the two air guide holes 220 are spaced apart by 180° in a circumferential direction of the inner tube 200. When there are more than two air guide holes 220, all the air guide holes 220 may be arranged at intervals uniformly in the circumferential direction of the inner tube 200. Since the air guide hole 220 is in communication with the accommodating cavity 21, when the quantity of the air guide holes 220 decreases, flow resistance for air in the accommodating cavity 21 entering the tube cavity 210 through the air guide hole 220 may be increased, to increase inhaling resistance for the user at the air outlet 110; and on the contrary, when the quantity of the air guide holes 220 increases, flow resistance for air in the accommodating cavity 21 entering the tube cavity 210 through the air guide hole 220 may be decreased, to decrease inhaling resistance for the user at the air outlet 110.

The inner tube 200 includes an abutting surface 230, and in an axial direction of the inner tube 200, the abutting surface 230 and the air guide hole 220 are spaced apart by a certain distance. For example, the abutting surface 230 is located above the air guide hole 220. The abutting surface 230 may define a partial boundary of the tube cavity 210, and the abutting surface 230 may form a set angle with the axial direction of the inner tube 200. For example, the abutting surface 230 may be a circular surface and the abutting surface 230 is disposed horizontally. In this case, the angle between the abutting surface 230 and the axial direction of the inner tube 200 is 90°, namely, the abutting surface 230 and the axial direction of the inner tube 200 are perpendicular to each other.

The inner tube 200 may be made of a stainless steel material. Since the stainless steel material has relatively high mechanical strength, in a case that a volume of the tube cavity 210 is certain, a thickness of the inner tube 200 may be properly reduced, to reduce a total volume of the inner tube 200, to finally reduce a space occupied by the inner tube 200 in the housing 100, thereby reducing a volume of the entire vaporizer 30 and a volume of the electronic vaporization device 10 to some extent. Certainly, the inner tube 200 may alternatively be made of a plastic material. The inner tube 200 may be integrally formed and connected. For example, the inner tube 200 made of a stainless steel material may be integrally formed through injection. According to the different materials, the inner tube 200 may alternatively be integrally formed through die casting.

The vaporization core 400 is fixed in the tube cavity 210, and the vaporization core 400 may include a substrate and a heating body. The heating body may use a strip-shaped heating wire or a sheet heating film, the heating body may be disposed on the substrate in an embedded manner or a direct tiled manner, and the heating body may alternatively be spirally wrapped on the substrate. The substrate may be made of a cotton material or a porous ceramic material, so that the substrate has a certain porosity and can generate capillary action, helping the substrate absorb and buffer the vaporization substrate from the liquid storage cavity 120. The heating body and the battery 22 are electrically connected through an electrode, when the battery 22 supplies power to the heating body through the electrode, the heating body generates heat, and the vaporization substrate buffered on the substrate absorbs thermal energy and is vaporized to form aerosols. Apparently, when the battery 22 stops supplying power to the heating body, the vaporization substrate in the substrate cannot absorb thermal energy and be vaporized.

The safety valve 300 may be made of a silica gel material, so that the safety valve 300 includes certain flexibility. A shape of the safety valve 300 matches a shape of the tube cavity 210, and for example, the safety valve 300 may be also a columnar structure.

The safety valve 300 includes a limiting surface 310 and a sensing surface 320. The sensing surface 320 and the limiting surface 310 are two end surfaces on an axial direction of the safety valve 300 and facing opposite directions, the sensing surface 320 is disposed facing the battery 22, and the limiting surface 310 is disposed facing away from the battery 22. A lower end of the tube cavity 210 of the inner tube 200 is an opening 211, and the opening 211 is in direct communication with the accommodating cavity 21. The safety valve 300 is at least partially disposed in the tube cavity 210 of the inner tube 200, and for example, the safety valve 300 is located at a position of the tube cavity 210 close to the opening 211. A space that is not filled by the safety valve 300 of the tube cavity 210 includes an airflow channel 212, the air guide hole 220 is in communication with the accommodating cavity 21 and the airflow channel 212, and the air outlet 110 is also in communication with the airflow channel 212.

Figure 5:
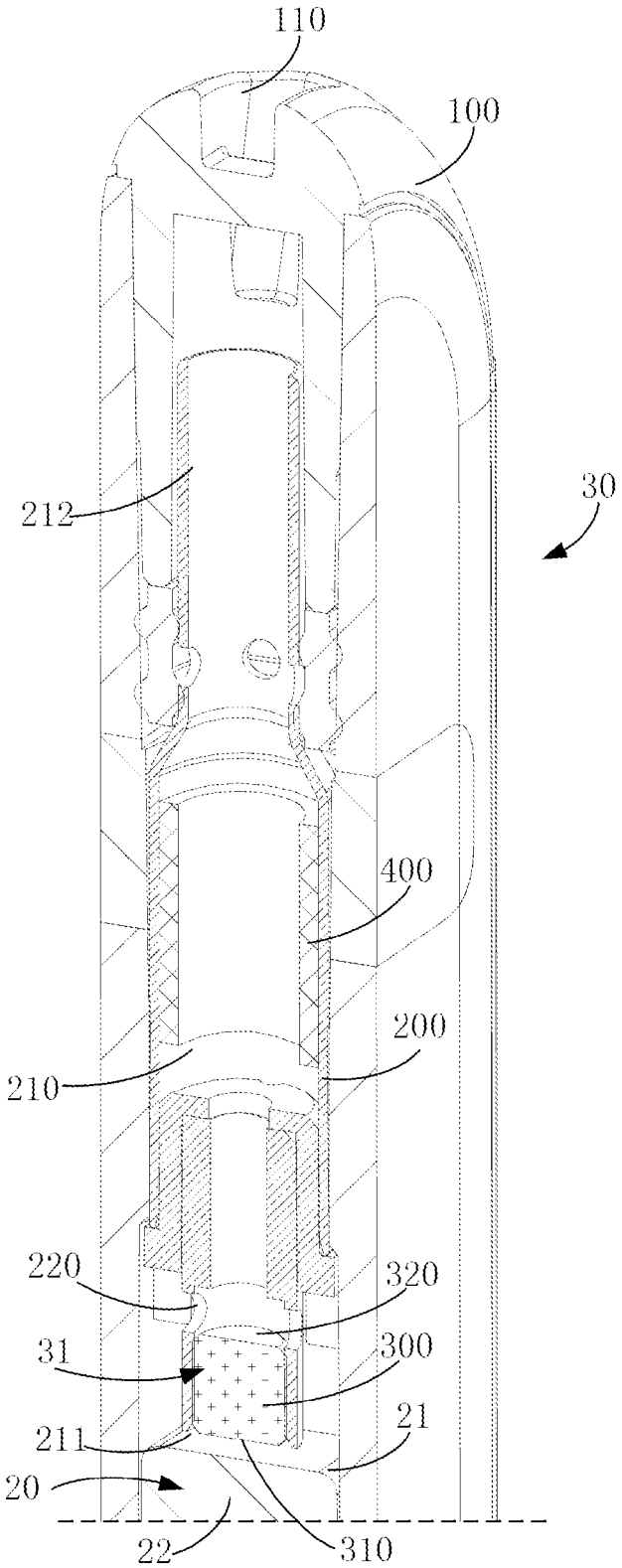
FIG. 5 is a three-dimensional schematic cross-sectional structural view in a second direction of the electronic vaporization device shown in FIG. 1 when a safety valve is located at a first position.

Referring to FIG. 5, the safety valve 300 may be in interference fit with the tube cavity 210. In a case that the battery 22 works normally, a difference between an air pressure in the accommodating cavity 21 and an air pressure in the airflow channel 212 is less than a threshold pressure, and the safety valve 300 is located at a first position 31 relative to the inner tube 200. In a case that the safety valve 300 is located at the first position 31, the safety valve 300 and the air guide hole 220 maintain a certain distance in the axial direction of the inner tube 200, namely, the safety valve 300 and the air guide hole 220 are disposed in a "staggered" manner. The safety valve 300 opens the air guide hole 220, the safety valve 300 does not block the air guide hole 220, and the air guide hole 220 is in an opened state. When the user inhales at the air outlet 110, the vaporization core 400 discharges aerosols formed after the vaporization substrate is vaporized into the airflow channel 212. Referring to FIG. 2 and FIG. 3, external air enters the airflow channel 212 through the air inlet hole 23, the accommodating cavity 21, and the air guide hole 220 sequentially, to carry the aerosols in the airflow channel 212 to the air outlet 110 to be inhaled by the user. Certainly, since the safety valve 300 is in interference fit with the tube cavity 210, there is no gap between the safety valve 300 and the inner tube 200, the external air in the accommodating cavity 21 cannot enter the airflow channel 212 through the opening 211 and the non-existent gap, and the external air in the accommodating cavity 21 can only enter the airflow channel 212 through the air guide hole 220.

Figure 6:
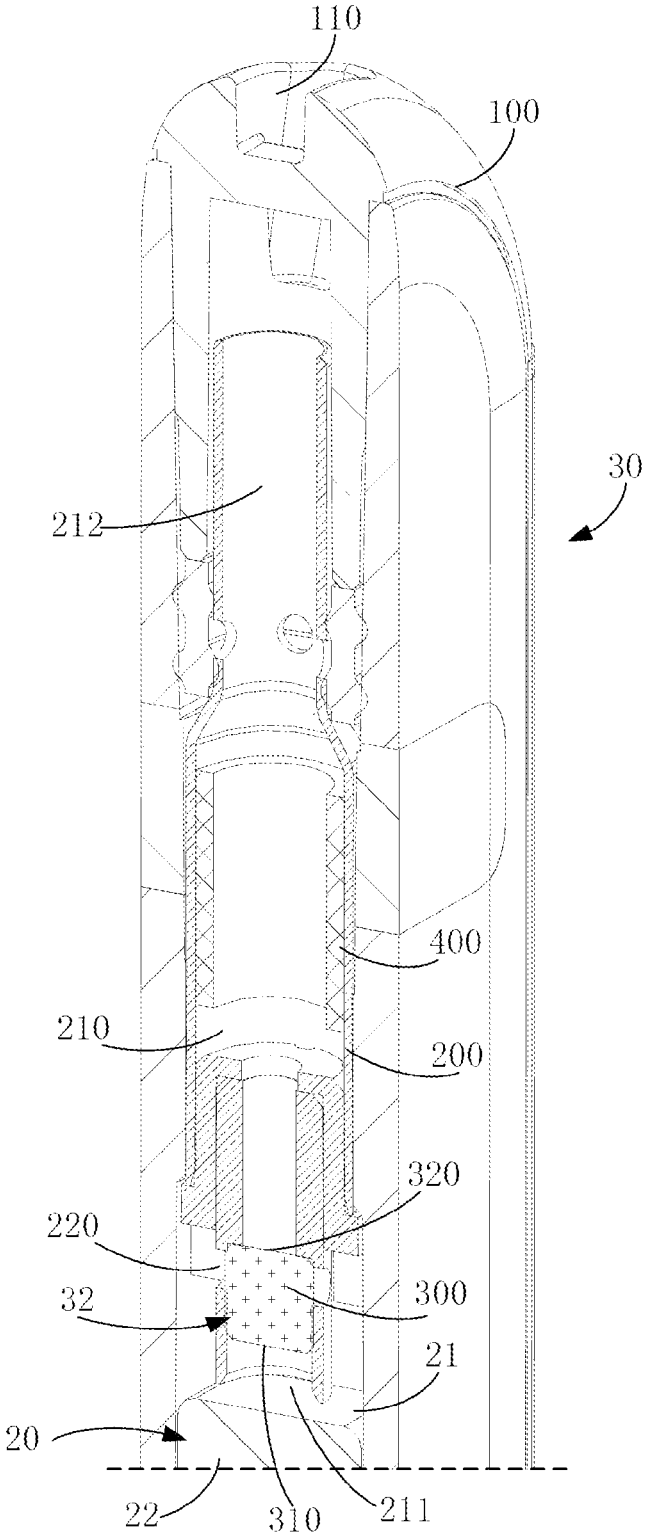
FIG. 6 is a three-dimensional schematic cross-sectional structural view in a second direction of the electronic vaporization device shown in FIG. 1 when a safety valve is located at a second position.

Referring to FIG. 6, in a case that the battery 22 explodes, the air pressure in the accommodating cavity 21 increases suddenly. As a result, the air pressure in the accommodating cavity 21 is far higher than the air pressure in the airflow channel 212, the air pressure in the accommodating cavity 21 directly acts on the sensing surface 320 through the opening 211 to form a first pressure, and the air pressure in the airflow channel 212 is less than or equal to an atmospheric pressure and acts on the limiting surface 310 to form a second pressure. Apparently, the first pressure is far greater than the second pressure, namely, the difference between the air pressure in the accommodating cavity 21 and the air pressure in the airflow channel 212 is greater than the threshold pressure.

In this case, the first pressure overcomes the second pressure, and due to the gravity of the safety valve 300 and the frictional force between the safety valve 300 and the inner tube 200, the safety valve 300 moves upward relative to the inner tube 200. When the limiting surface 310 moves to abut against the abutting surface 230, through an interference effect of the abutting surface 230, the safety valve 300 slides upward to a limit position relative to the inner tube 200. In this case, the safety valve 300 is located at a second position 32, the safety valve 300 stops sliding relative to the inner tube 200, and the safety valve 300 and the air guide hole 220 are located at the same position in the axial direction of the inner tube 200. That is, the safety valve 300 and the air guide hole 220 are disposed in a "flush" manner, the safety valve 300 blocks the air guide hole 220, and the air guide hole 220 is in a closed state.

Referring to FIG. 6, therefore, in a case that the battery 22 explodes, the safety valve 300 moves from the first position 31 to the second position 32 to block the air guide hole 220, so that shock waves formed by the explosion of the battery 22 cannot carry powders and harmful gas to the air outlet 110 through the air guide hole 220 and the airflow channel 212 to be inhaled by the user, thereby preventing impacting force of the explosion and the powders and harmful gas from causing damage to a human body, and improving the use security of the electronic vaporization device 10. In addition, since the safety valve 300 is in interference fit with the tube cavity 210, there is no gap between the safety valve 300 located at the second position 32 and the inner tube 200, so that the powders and harmful gas also cannot enter the airflow channel 212 through the non-existent gap to the air outlet 110 to be inhaled by the user. In addition, the safety valve 300 made of a silica gel material has certain flexibility. When the limiting surface 310 and the abutting surface 230 collides violently, elastic deformation of the safety valve 300 may absorb certain impact, so that the safety valve 300 can well buffer the impact. On one hand, strong collision noise generated due to collision between the limiting surface 310 and the abutting surface 230 may be avoided, and discomfort caused by the noise to the user and a surrounding environment may be prevented. On the other hand, the inner tube 200 or the safety valve 300 may be prevented from being damaged due to the violent collision to form a crack, thereby preventing the powders and harmful gas from reaching the air outlet 110 through the crack to be inhaled by the user, and the use security of the electronic vaporization device 10 may be also improved to some extent.

In some embodiments, a value range of the threshold pressure may be from 1 KPa to 2 Mpa, and a specific value may be 1 KPa, 2 KPa, 1.5 MPa, or 2 MPa. The value range of the threshold pressure may alternatively be from 2 KPa to 2 Mpa or from 10 KPa to 1 MPa. When the threshold pressure ranges from 10 KPa to 1 MPa, on one hand, the safety valve 300 moving from the first position 31 to the second position 32 due to an excessive inhaling force of the user may be avoided, so that the electronic vaporization device 10 can be ensured to work normally in a case that the battery 22 does not explode; and on the other hand, the safety valve 300 can move from the first position 31 to the second position 32 in time to block the air guide hole 220 in an early stage when the battery 22 explodes, thereby further improving a safety coefficient of the electronic vaporization device 10 during usage.

The technical features in the foregoing embodiments may be randomly combined. For concise description, not all possible combinations of the technical features in the embodiments are described. However, provided that combinations of the technical features do not conflict with each other, the combinations of the technical features are considered as falling within the scope described in this specification.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporizer for an electronic vaporization device, comprising:

an accommodating cavity accommodating a battery;

a housing comprising an air outlet;

a safety valve;

an inner tube disposed in the housing; and a vaporization core disposed in a tube cavity of the inner tube, wherein the air outlet is on one end of the inner tube, wherein the safety valve is at least partially disposed in the tube cavity of the inner tube, the tube cavity comprising an airflow channel, the airflow channel being provided between the safety valve and the air outlet, wherein the inner tube comprises an air guide hole, the air guide hole being configured for airflow to run through the airflow channel and the accommodating cavity, the air guide hole comprising openings on both an outer wall surface and an inner wall surface of the inner tube, wherein, when a difference between an air pressure in the accommodating cavity and an air pressure in the airflow channel is less than a threshold pressure, the safety valve is located at a first position so as to cause the air guide hole to be in an opened state, wherein, when the difference between the air pressure in the accommodating cavity and the air pressure in the airflow channel is greater than the threshold pressure, the safety valve is configured to move from the first position to a second position so as to cause the air guide hole to be in a closed state, wherein, when the safety valve is located at the first position, the safety valve and the vaporization core are located on two opposite sides of the air guide hole in an axial direction of the inner tube, wherein an end portion of the tube cavity comprises an opening that is in direct communication with the accommodating cavity, wherein the inner tube comprises an abutting surface forming a set angle with an axial direction of the inner tube and defining a partial boundary of the tube cavity, wherein the safety valve comprises a limiting surface disposed facing away from the battery, wherein, when the safety valve is located at the second position, the limiting surface is configured to abut against the abutting surface of the inner tube, and wherein the abutting surface is disposed perpendicular to the axial direction of the inner tube.

2. The vaporizer of claim 1, wherein the safety valve is in interference fit with the tube cavity, and wherein the safety valve is configured to overcome frictional resistance and move from the first position to the second position.

3. The vaporizer of claim 2, wherein the safety valve is configured to slide from the first position to the second position.

4. The vaporizer of claim 2, wherein the safety valve comprises a sensing surface disposed facing the battery, and wherein the air pressure in the accommodating cavity directly acts on the sensing surface through the opening.

5. The vaporizer of claim 1, wherein a value range of the threshold pressure is from 1 KPa to 2 Mpa.

6. The vaporizer of claim 5, wherein a value range of the threshold pressure is from 10 KPa to 1 Mpa.

7. The vaporizer of claim 1, further comprising at least one of:

the inner tube being integrally formed and connected; and the inner tube comprising a stainless steel material, and the safety valve comprising a silica gel material.

8. The vaporizer of claim 1, wherein the air guide hole and the abutting surface are spaced apart.

9. The vaporizer of claim 1, wherein the abutting surface comprises a circular surface.

10. The vaporizer of claim 1, wherein the safety valve comprises a sensing surface and the limiting surface, the sensing surface and the limiting surface being two end surfaces on an axial direction of the safety valve and facing opposite directions, the sensing surface being disposed facing the battery.

11. The vaporizer of claim 1, wherein the safety valve is configured to slide within the tube cavity of the inner tube from the first position to the second position, and wherein the abutting surface of the inner tube arrests the safety valve at the second position.

12. An electronic vaporization device, comprising:

a power supply assembly; and the vaporizer of claim 1 connected thereto, wherein the power supply assembly comprises the accommodating cavity and the battery accommodated in the accommodating cavity.

* * * * *